US010584473B2

(12) United States Patent
Crosby

(10) Patent No.: US 10,584,473 B2
(45) Date of Patent: Mar. 10, 2020

(54) CONTROLLING A VACUUM SEWER SYSTEM

(71) Applicant: Legend Energy Advisors LLC, New York, NY (US)

(72) Inventor: Daniel Crosby, New York, NY (US)

(73) Assignee: LEGEND ENERGY ADVISORS, New York, NY (US)

( * ) Notice: Subject to any disclaimer, the term of this patent is extended or adjusted under 35 U.S.C. 154(b) by 99 days.

(21) Appl. No.: 15/835,894

(22) Filed: Dec. 8, 2017

(65) Prior Publication Data

US 2019/0177179 A1 Jun. 13, 2019

(51) Int. Cl.
*E03F 5/22* (2006.01)
*E03F 1/00* (2006.01)

(52) U.S. Cl.
CPC ..... *E03F 5/22* (2013.01); *E03F 1/006* (2013.01)

(58) Field of Classification Search
CPC ..... E03F 1/006; E03F 5/22
See application file for complete search history.

(56) References Cited

U.S. PATENT DOCUMENTS 3,252,478 A * 5/1966 Limberger ..... G03D 3/06 137/565.37
4,179,371 A 12/1979 Foreman et al.
4,691,731 A 9/1987 Grooms et al.
5,044,836 A 9/1991 Grooms
5,064,314 A 11/1991 Grooms et al.
5,261,437 A 11/1993 Kalix
5,553,094 A 9/1996 Johnson et al.
5,570,715 A 11/1996 Featheringill et al.
5,588,458 A 12/1996 Ushitora et al.
5,615,978 A 4/1997 Kotani et al.
5,871,027 A 2/1999 Shimizu et al.
6,286,602 B1 9/2001 Lemetayer et al.
7,481,100 B2 1/2009 Ponziani et al.
9,828,757 B2 11/2017 Boren
2005/0016588 A1 1/2005 Shimizu et al.
2006/0150749 A1 7/2006 Eken et al.
(Continued)

FOREIGN PATENT DOCUMENTS

AU 2014201028 B2 5/2016
EP 0826838 A2 3/1998
GB 2247327 A 2/1992
JP 2003217059 A 7/2003
(Continued)

OTHER PUBLICATIONS

International Search Report for PCT/US2018/062022 (Controlling a Vacuum Sewer System, filed Nov. 20, 2018), issued by ISA/EP, 5 pages (dated Feb. 25, 2019).
(Continued)

*Primary Examiner* — Eric Keasel
(74) *Attorney, Agent, or Firm* — Burns & Levinson

(57) ABSTRACT

An example system includes a sewage pit; a suction pipe extending into the sewage pit; and a valve between the sewage pit and a vacuum pipe having a vacuum pressure. The valve is controllable to close or to open to allow content to flow from the sewage pit, through the suction pipe, to the vacuum pipe. A sensor tube extends into the sewage pit to sense a fill level of the sewage pit. The suction pipe is configured as a back-up to the sensor tube for sensing the fill level of the sewage pit. The valve is controllable based on a pressure in at least one of the suction pipe or the sensor tube meeting or exceeding a predefined level.

22 Claims, 4 Drawing Sheets

(56) References Cited

U.S. PATENT DOCUMENTS

| | | | |
|---|---|---|---|
| 2008/0314122 | A1 | 12/2008 | Hunaidi et al. |
| 2009/0216205 | A1 | 8/2009 | Ryan et al. |
| 2011/0180161 | A1 | 7/2011 | Boren |
| 2011/0192465 | A1 | 8/2011 | Collings, III |

FOREIGN PATENT DOCUMENTS

| | | | |
|---|---|---|---|
| WO | WO-2008057076 | A1 | 5/2008 |
| WO | WO-2011094237 | A2 | 8/2011 |

OTHER PUBLICATIONS

Written Opinion for PCT/US2018/062022 (Controlling a Vacuum Sewer System, filed Nov. 20, 2018), issued by ISA/EP, 9 pages (dated Feb. 25, 2019).
File History of U.S. Pat. No. 9,828,757, retrieved Sep. 6, 2018 (774 pages).
Invitation to Pay Additional Fees and, Where Applicable, Protest Fee from PCT Application No. PCT/US2011/022477 dated Jun. 16, 2011 (2 pages).
Search report and Written Opinion from PCT Application No. PCT/US2011/022477 dated Aug. 30, 2011 (6 pages).
Transaction history of PCT Application No. PCT/US2011/022477 (retrieved Jul. 17, 2015).
Transaction history of U.S. Appl. No. 61/298,666, retrieved Jul. 17, 2015 (45 pages).
Transaction history of U.S. Appl. No. 61/315,341, retrieved Jul. 17, 2015 (76 pages).
File History of U.S. Appl. No. 15/788,804 (downloaded Nov. 5, 2019) (173 pages).

* cited by examiner

CONTROLLING A VACUUM SEWER SYSTEM

TECHNICAL FIELD

This specification relates generally to processes for controlling a vacuum sewer system.

BACKGROUND

A vacuum sewer system is configured to transport waste, such as sewage, from various sewage pits to a vacuum station, which may be, or include, a waste treatment facility. In some examples, a vacuum sewer system relies on a vacuum in a network of pipes in fluid communication with the vacuum station. A difference in pressure between the pipes and the sewage pits allows the system to extract the waste from the sewage pits. The waste is transported over a series of pipes, or other conduits, that ascend, descend, ascend, descend, and so forth, until the vacuum station is reached. Air through the system assists in moving the waste through the series of pipes. In some systems, the waste can be elevated only about four (4) or five (5) feet at a time, hence the need for sections of pipes that alternate between ascending and descending.

SUMMARY

An example system includes a sewage pit; a suction pipe extending into the sewage pit; and a valve between the sewage pit and a vacuum pipe having a vacuum pressure. The valve is controllable to close or to open to allow content to flow from the sewage pit, through the suction pipe, to the vacuum pipe. A sensor tube extends into the sewage pit to sense a fill level of the sewage pit. The suction pipe is configured as a back-up (e.g., a redundancy) to the sensor tube for sensing the fill level of the sewage pit. The valve is controllable based on a pressure in at least one of the suction pipe or the sensor tube meeting or exceeding a predefined level. The example system may include one or more of the following features, either alone or in combination.

In response to the pressure in at least one of the suction pipe or the sensor tube meeting or exceeding the predefined level, the valve may be controllable to open and thereby allow content to flow from the sewage pit to the vacuum pipe. The valve may be controllable to remain open for a period of time to evacuate at least part of the content from the sewage pit. The period of time may be user-settable. The valve may be controllable to close following the predetermined period of time after opening.

The example system may include a switch configured to close in response to the pressure meeting or exceeding the predefined level. Opening of the valve may be based on closing of the switch. The example system may include a servo-motor configured for activation in response to closure of the switch. The servo-motor may be configured to control opening the valve following activation. Control over the valve may be direct or indirect, e.g., control over the valve may be implemented by controlling one or more other components that directly control the valve.

The predefined level may be indicative of a fill level of the sewage pit. The valve may be controlled based on the pressure in the suction pipe only. The valve may be controlled based on the pressure in the sensor tube only. In a case that there is an error associated with the pressure in the sensor tube, the valve may be controllable based on the pressure in the suction pipe only. The suction pipe may have a serrated end that extends into the sewage pit.

The example system may include a remote computing system configured to process information relating to multiple sewage pits, including the sewage pit, to identify at least one of an operational characteristic of a sewer system comprised of the sewage pits or a problem associated with the sewer system. The problem may include at least one of breakage, a leak, or a blockage in the sewage line.

An example system includes a sewage pit; a suction pipe extending into the sewage pit; and a valve between the sewage pit and a vacuum pipe having a vacuum pressure. The valve is controllable to close or to open to allow content to flow from the sewage pit, through the suction pipe, to the vacuum pipe. The valve is controllable to open for a predefined period of time. The example system may include one or more of the following features, either alone or in combination.

The predefined period of time may be settable by an administrator of the system. The predefined period of time may be between one (1) second (s) and three (3) seconds. The predefined period of time may be at least one (1) second. The predefined period of time may be independent of air, liquid, or both liquid and air passing through the valve, e.g., amounts of liquid, air, or both passing through the valve.

The example system may include a switch configured to close in response to a pressure associated with the sewage pit meeting or exceeding a predefined level. Opening of the valve may be based on closing of the switch. The example system may include a servo-motor configured for activation in response to closure of the switch. The servo-motor may be configured to control opening the valve following activation. The example system may include a sensor tube extending into the sewage pit. A pressure associated with the sensor tube may be indicative of a fill level of the sewage pit. Opening of the valve may be based on the pressure.

An example system includes a sewage pit; a vacuum pipe to provide vacuum pressure for evacuating the sewage pit; a valve between the vacuum pipe and the sewage pit; and a controller to control operation of the valve so that the valve remains open for a period of time to evacuate at least part of the sewage pit via the vacuum pipe. The period of time may be programmable into the controller. The example system may include one or more of the following features, either alone or in combination.

The controller may be configured to send first information to, and to receive second information from, a remote computing system. The second information may include a user-set time. The user-set time may be the period of time programmable into the controller. The example system may include a sensor tube to sense a pressure corresponding to a fill level of the sewage pit.

The controller may be configured to monitor the pressure in the sensor tube and to control opening of the valve based on the pressure in the sensor tube. The controller may be configured to close the valve following the predetermined period of time after the valve is open, thereby causing the valve to be open for the predetermined period of time. The controller may include a switch configured to close in response to the pressure corresponding to the fill level. The controller may operate in response to closure of the switch to control intermediary components to control opening of the valve. The intermediary components may include a servo-motor or a stepper motor configured for activation in response to closure of the switch. The servo-motor or the stepper motor may be configured to control opening the valve following activation.

The example system may include a suction pipe between the sewage pit and the valve. The controller may be configured to monitor the suction pipe to sense a pressure in the suction pipe. The pressure in the suction pipe may be indicative of a fill level of the sewage pit. The controller may be configured to control opening of the valve based on the pressure in the suction pipe. The controller may be configured to close the valve following the predetermined period of time after the valve is open, thereby causing the valve to be open for the predetermined period of time.

The example system may include a suction pipe between the sewage pit and the valve; and a sensor tube having a pressure corresponding to a fill level of the sewage pit. The controller may be configured to monitor the pressure in the sensor tube. The controller may be configured to monitor a pressure in the suction pipe. The pressure in the suction pipe may be indicative of the fill level of the sewage pit. The controller may be configured to control opening of the valve based on at least one of the pressure in the sensor tube or the pressure in the suction pipe. The controller may be configured to close the valve following the predetermined period of time after the valve is open, thereby causing the valve to be open for the predetermined period of time. The controller may be configured to determine that there is an error associated with monitoring pressure via the sensor tube in a case where the suction pipe had pressure and the suction tube does not have at least a predefined pressure. In a case that there is the error, the controller may be configured to control opening of the valve based on the pressure in the suction pipe alone.

The example system may include a suction pipe between the sewage pit and the valve. The controller may be configured to monitor the suction pipe to sense a loss of pressure. The loss of pressure in the suction pipe may be indicative of a leak in the valve. The controller may be configured to monitor the vacuum pipe and to determine whether a pressure in the vacuum pipe is sufficient to control operation of the valve. The suction pipe may pass content from the sewage pit through the vacuum valve. The suction pipe may extend into the sewage pit below a predetermined fill level of the sewage pit, the suction pipe having serrated end.

The example system may include a remote computing system to communicate with the controller. The controller may be configured to communicate with the remote computing system periodically. The controller may be configured based on data received from the remote computing system. The controller may be configured to control operation of the valve based on data received from the remote computing system. The data may instruct the controller to open the valve or to close the valve.

The example system may include a remote computing system to communicate with the controller. The controller may be configured to communicate operational data relating to the sewage pit to the remote computing system. The remote computing system may be configured to process information received relating to multiple sewage pits, including the sewage pit, to identify at least one of an operational characteristic of a sewer system comprised of the sewage pits or a problem associated with the sewer system. The problem may include at least one of breakage, a blockage, or a leak in the sewage line. The controller may be configured to monitor the vacuum pipe and to determine whether a pressure in the vacuum pipe is sufficient to control operation of the vacuum valve. The controller may be configured to send information representing the pressure to the remote computing system.

Any two or more of the features described in this specification, including in this summary section, can be combined to form implementations not specifically described herein.

The systems and techniques and processes described herein, or portions thereof, can be implemented as/controlled by a computer program product that includes instructions that are stored on one or more non-transitory machine-readable storage media, and that are executable on one or more processing devices to control (e.g., coordinate) the operations described herein. The systems and techniques and processes described herein, or portions thereof, can be implemented as an apparatus, method, or electronic system that can include one or more processing devices and memory to store executable instructions to implement various operations.

The details of one or more implementations are set forth in the accompanying drawings and the description below. Other features, objects, and advantages will be apparent from the description and drawings, and from the claims.

DESCRIPTION OF THE DRAWINGS

Like reference numerals in different figures indicate like elements.

DETAILED DESCRIPTION

Described herein are example implementations of processes ("the process") for controlling at least part of a vacuum sewer system. An example vacuum sewer system includes, but is not limited to, a sewage pit, a vacuum pipe to provide vacuum pressure for evacuating the sewage pit, and a valve between the vacuum pipe and the sewage pit. A controller is configured—for example, programmed—to control operation of the valve so that the valve remains open for a period of time to evacuate at least part of the sewage pit via the vacuum pipe. The period of time may be programmable into the controller. For example, the period of time may be set by a user or administrator of the vacuum sewer system, and conveyed to the controller. The period of time set by the user or administrator may be independent of, e.g., not set based on, air, liquid, or both air and liquid passing through the open valve.

In this regard, an example controller may include one or more processing devices, one or more switches, and one or more other components resident on one or more circuit boards. In this example, the one or more processing devices constitute the on-board intelligence of the controller. The one more processing devices, examples of which are described herein, may be configured to communicate with a remote computing system, which may also include one or more processing devices, examples of which are described herein. The controller thus may communicate with the remote computing system to receive information, such as data, indicating how and when to control operation of the valve and, thus, operation of the sewage pit. In an example, the remote computing system may transmit a user- or administrator-set period of time to keep the valve open when evacuating the sewage pit. The controller may use this period of time to control the duration that the valve is open. In an example, the remote computing system may send commands to the controller to control operation of the valve directly. Other example operations are described herein. In some implementations, the controller may be, or include, a pneumatic controller.

Figure 1:
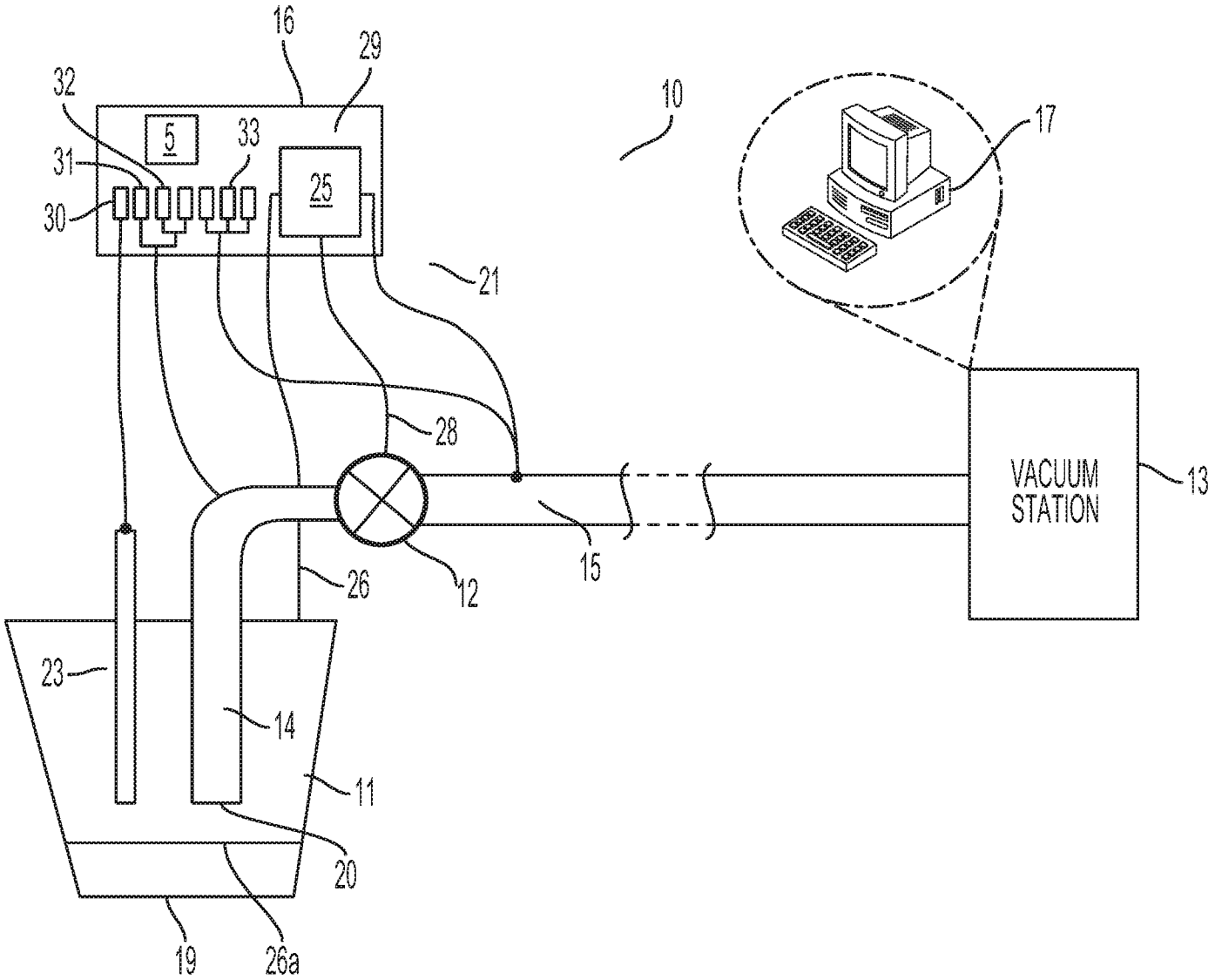
FIG. 1 is a block diagram of a part of an example vacuum sewer system.

FIG. 1 shows components of a part of an example vacuum sewer system 10. The process and its variations; however, are not limited to a vacuum sewer system having the components of FIG. 1. The process may be used in any appropriate context.

Vacuum sewer system 10 includes a sewage pit 11. Sewage pit 11 is a repository, such as a local storage facility, that stores waste including, but not limited to, human waste, water run-off, and other content to be eliminated via the vacuum sewer system. Sewage pit 11 may be of any appropriate size. An example sewage pit is ten (10) gallons in volume; however, the process is not limited to use with sewage pits of this size. The example sewage pit may service a number of buildings or residences, depending upon its size. Example vacuum sewer systems may include any appropriate number of sewages pits and corresponding components of the type shown in FIG. 1 or otherwise. As described, these sewage pits may be connected via a series of pipes, or other conduits, that ascend, then descend, then ascend, then descend, and so forth, until a vacuum station 13 is reached. Waste may be evacuated from the sewage pit using vacuum valve 12, and transported over the series of pipes to the vacuum station for disposal, processing, or both disposal and processing.

Figure 3:
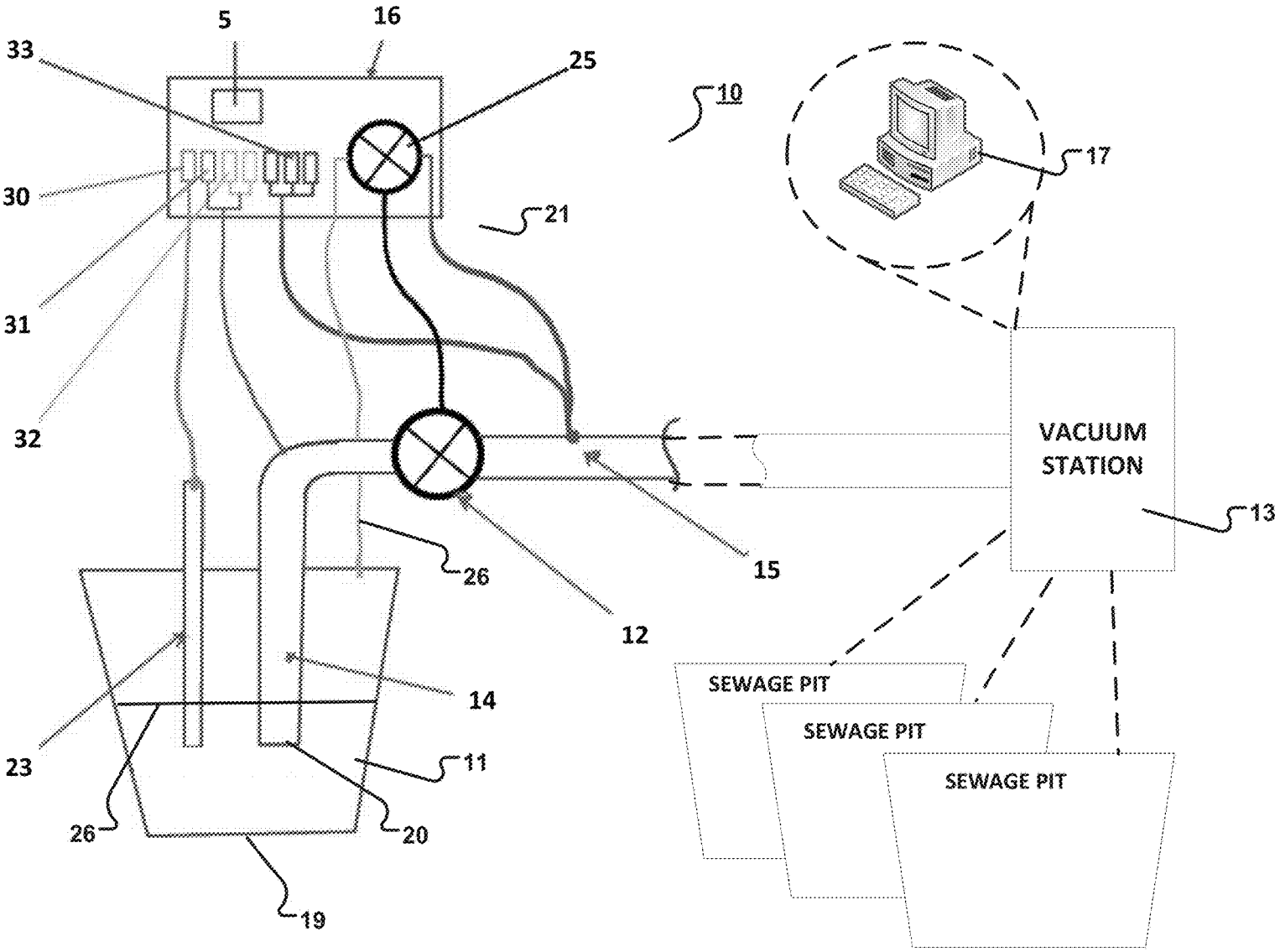
FIG. 3 is a block diagram of the part of the example vacuum sewer system, which also shows a higher sewage pit fill level than in FIG. 1.

Vacuum valve 12 may be constructed using any appropriate technology. In some implementations, vacuum valve 12 is made of rubber or other appropriate type material configured to create an air-tight and liquid-tight seal between suction pipe 14 and vacuum pipe 15. Vacuum pipe 15 is part of, or connected to, the series of pipes, or other conduits, that ascend, descend, ascend, descend, and so forth, until the vacuum station is reached. Vacuum pipe 15 may be made of plastic or other appropriate material or materials. Vacuum pressure may be a pressure that is lower than ambient atmospheric pressure, e.g., 0 PSIA (pounds per square inch absolute) to below 14.7 PSIA. Vacuum pressure is maintained in vacuum pipe 15 by the vacuum station. For example, the vacuum station generates vacuum that travels through the system to reach the vacuum pipe. In some implementations, the farther a sewage pit is located from the vacuum station, the lower the level of vacuum in the vacuum pipe will be. In some implementations, sewage pits that are relatively closer to the vacuum station may have vacuums of around fifteen (15) inches of mercury or more. In some implementations, sewage pits that are relatively farther from the vacuum station may have vacuums of around ten (10) inches of mercury. In some implementations, five (5) inches of mercury is insufficient vacuum pressure to open the vacuum valve 12. In some implementations, however, five (5) inches of mercury may be sufficient vacuum pressure to open the vacuum valve 12. As described, controller 16 may be configured to detect the level or magnitude of vacuum in vacuum pipe 15 or lack thereof, and to report that information to remote computing system 17. The information may include an alert if insufficient vacuum is detected. In the example of FIGS. 1 and 3, remote computing system is located at the vacuum station 13; however, the remote computing system may be at any appropriate physical location.

Figure 2:
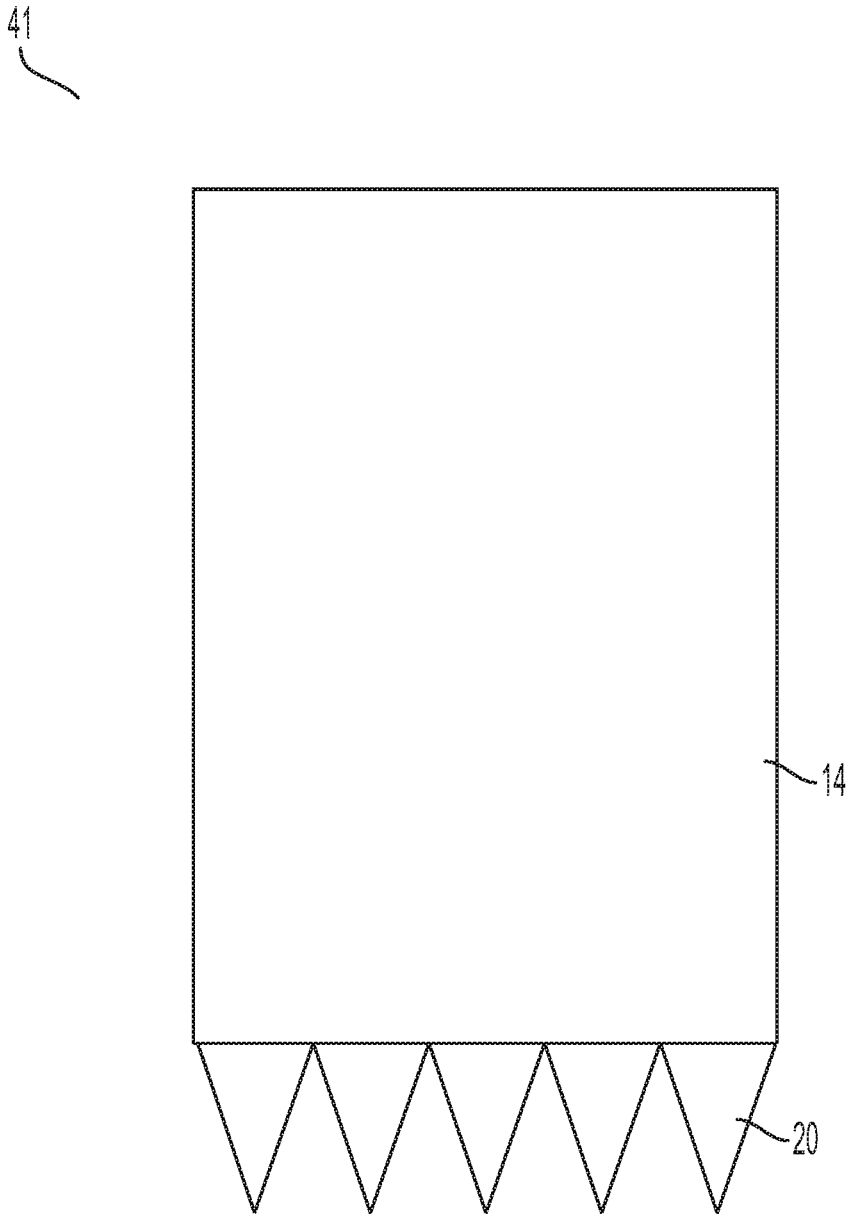
FIG. 2 a cut-away, side view of an example suction pipe that is part of the example vacuum sewer system.

In the example of FIG. 1, suction pipe 14 extends towards, and into, sewage pit 11 at least below a predefined fill level of the sewage pit. In this example, suction pipe extends a predetermined depth into the sewage pit—for example, to one (1) inch or more above the floor 19 of the sewage pit. In this regard, in some implementations, the vacuum sewer system evacuates the sewage pit to one (1) inch below the termination or end 20 of suction pipe 14. In some implementations, the termination or end 20 of suction pipe 14 is at least partly serrated. A close-up example of this configuration for end 20 is shown in FIG. 2. The serrated end may reduce the chances that waste will clog the suction pipe, thereby facilitating evacuation of the sewage pit.

The suction pipe is configured as a back-up to a sensor tube, described below, for sensing the fill level of the sewage pit. For example, the sensor tube is used to sense the fill level of the sewage pit. The suction pipe is configured, e.g., connected to the controller, to act as a redundant mechanism (e.g., a back-up) for sensing the fill level of the sewage pit. Accordingly, the combination of the sensor tube and the suction pipe may reduce the chances that a sewage pit will not be evacuated when needed.

As the sewage pit fills, the fill level **26*a* of the waste or other content rises, so that the end, and more, of suction pipe 14 is submerged, as shown in FIG. 3 The end, and more, of sensor tube 23, which is described below, also becomes submerged as the waste rises. At some time, controller 16** makes a decision to evacuate the sewage pit. In some implementations, as the fill level of the waste rises, pressure increases in both the suction pipe and the sensor tube. The controller may be configured to monitor the sensor tube, the suction pipe, or both the suction pipe and the sensor tube to detect a predetermined pressure. In response to determining that the predetermined pressure has been reached, the controller may control operation of the vacuum valve automatically so that the vacuum valve remains open for a period of time to evacuate at least part of e.g., all or part of the sewage pit via the vacuum pipe. In some implementations, the controller may control operation of the vacuum valve based on one or more commands received from the remote computing system. For example, control over operation of the vacuum valve may be independent of the pressure in the sensor tube, the suction pipe, or both, and may be reliant solely on commands from received from the remote computing system. In some implementations, the controller may control operation of the vacuum valve based on a combination of one or more commands received from the remote computing system and the pressure in the sensor tube, the pressure in the suction pipe, or both of these pressures.

In an example, the controller may sense a predetermined pressure in the sensor tube and/or the suction pipe, and control the vacuum valve to open. Following opening, the controller may cause the vacuum valve to close after the user- or administrator-set period of time. In an example, the controller may control the vacuum valve to open in response to an external command or other trigger that is independent of (e.g., not based on) the pressure in the sensor tube and/or the suction pipe. Following opening, the controller may cause the vacuum valve to close after the user- or administrator-set period of time. In an example, the controller may sense a predetermined pressure in the sensor tube and/or the suction pipe, and control the vacuum valve to open. Following opening, the controller may wait to receive a command to cause the vacuum valve to close, and close the vacuum valve following receipt of the command.

After controller 16 determines to open the vacuum valve, controller 16 operates, through intermediary components 21—examples of which are described below—to enable vacuum valve to open. After, or upon, opening of the vacuum valve, vacuum pressure in vacuum pipe 15 causes waste from the sewage pit to evacuate via suction pipe 14, and to enter vacuum pipe. That is, the vacuum pressure in the vacuum pipe suctions the waste through the suction pipe, past the vacuum valve, and into the vacuum pipe. From there, the waste is transported along the series of pipes, or other conduits, that may ascend, descend, ascend, descend, and so forth, until the vacuum station is reached. In this example, the vacuum valve is controlled to stay open for the user- or administrator-set period of time, whereafter the vacuum valve is controlled to close. As explained, the controller obtains the user- or administrator-set period of time from the remote computing system or other appropriate computing system. That user- or administrator-set period of time is stored, by the controller, in computer memory and is used to control operation of the vacuum valve. In some implementations, the controller records the time at which the vacuum valve is opened, and then counts-down, or otherwise keeps track of, the user- or administrator-set period of time, after which the controller performs control operations to cause the vacuum valve to close. Hence, the vacuum valve remains open, in this example, for the user- or administrator-set period of time. In some implementations, the user- or administrator-set period of time is between one (1) second (s) and three (3) seconds. In some implementations, the user- or administrator-set period of time is at least (1) second, at least two (2) seconds, at least three (3) seconds, at least four (4) seconds, at least five (5) seconds, at least six (6) seconds, at least seven (7) seconds, at least eight (8) seconds, at least nine (9) seconds, at least ten (10) seconds, at least eleven (11) seconds, at least twelve (12) seconds, at least thirteen (13) seconds, at least fourteen (14) seconds, at least fifteen (15) seconds, and so forth. However, the user- or administrator-set period of time is not limited to these values, and may have any appropriate values.

As noted, in some implementations, the sewage pit is evacuated to one (1) inch below the ends of the suction pipe and the sensor tube. However, the processes are not limited to this evacuation level, and any appropriate evacuation level may be achieved. In this example, sensor tube 23 is a pressure sensor that extends into, and below, a predetermined fill level of the sewage pit. For example, sensor tube may extend to one (1) inch or more above the floor 19 of sewage pit 11. As was the case with suction pipe 14, as the sewage pit fills, the pressure in sensor tube 23 increases. In some implementations, controller 16 is configured to sense this pressure, to compare the pressure against a predetermined pressure and, when the predetermined pressure is reached, to perform operations to open vacuum valve 12, thereby allowing the sewage pit to evacuate. In some implementations, controller 16 contains a switch 30 that is operable based on the pressure sensed in the sensor tube. When the predetermined pressure is reached, the switch closes. In an example, this results in a contact closure on a circuit board 29 containing the processing device(s) and switch. The contact closure indicates to on-board intelligence (e.g., one or more processing devices) in the controller the predetermined pressure has been reached in the sensor tube. As a result, the controller controls one or more intermediary devices to open vacuum valve 12. In this regard, vacuum valve 12 may include a control port. When the control port is exposed to vacuum, the vacuum valve is enabled to open. When the control port is exposed to atmospheric pressure, the vacuum valve closes. In this example, controlling the vacuum valve to open includes exposing the control port to vacuum, thereby opening the vacuum valve and allowing the sewage pit to evacuate. When the vacuum valve is to be closed, the control port is exposed to atmospheric pressure and, as a result, a spring forces the vacuum valve into a closed position, thereby preventing waste from passing from the sewage pit to vacuum pipe 15.

Examples of components that may be used to implement the intermediary device to open the vacuum valve include, but are not limited to, one or more servo-motors, one or more stepper motors, or one or more solenoid switches, or a combination of one or more servo-motors, one or more stepper motors, and/or one or more solenoid switches. Servo-motor-driven valves generally require lower voltage than solenoid-driven valves, which can be advantageous in systems that require battery power, since a site may require less frequent service. In some implementations, the intermediary device may also include one or more switches or valves that are between (a) the servo-motor, the stepper motor, or the solenoid switch and (b) the vacuum valve, and that are controlled by the servo-motor, stepper motor, or solenoid switch to control the vacuum valve. Thus, in some implementations, the vacuum valve is indirectly controlled through one or more intervening devices. For example, in response to one or more commands or instructions from the controller, a servo motor, a stepper motor, or a solenoid switch may control an intermediary valve (not shown) between the servo-motor, the stepper motor, or the solenoid switch and the vacuum valve, which controls opening of the vacuum valve by exposing the vacuum valve to vacuum pressure. In some implementations, the servo-motor, the stepper motor, or the solenoid switch controls the vacuum valve directly by exposing it to atmospheric pressure or vacuum.

As noted, controller 16 is also configured to monitor suction pipe 14 to sense a pressure in the suction pipe, with the pressure in the suction pipe—like the pressure in sensor tube 23—being indicative of a fill level of the sewage pit. The controller may also be configured to control operation of the vacuum valve based on the pressure sensed in the suction pipe. For example the controller may be responsive to a switch 31 that is operable based on the pressure sensed in the suction pipe. When a predetermined pressure is reached in the suction pipe—which may be the same predetermined pressure in the sensor tube or a different predetermined pressure—switch 31 closes. In an example, this results in a contact closure on the circuit board comprising the processing device(s) and switch. This contact closure indicates to a processor in the controller that a predetermined pressure has been reached. Thus, controller 16 monitors the pressure in both the suction pipe and the sensor tube to control operation of the vacuum valve. Following opening, the vacuum valve is closed after the user- or administrator-set period of time, as described above.

The pressure in the suction pipe thus acts as a back-up indication for the pressure in the sensor tube. For example, if the sensor tube is inoperable or compromised, the pressure in the suction pipe may be used to trigger operation of the vacuum valve. The controller may report to the remote computing system if an error has occurred in the sensor tube or the suction pipe. For example, if monitoring of the suction pipe results in a determination that the sewage pit should be evacuated, and monitoring of the sensor tube does not result in the same determination at the same time or at an appropriate different time, the controller may report to the remote computing system that there is a problem with the sensor tube. For example, if monitoring of the sensor tube results in a determination that the sewage pit should be evacuated, and monitoring of the suction pipe does not result in the same determination at the same time or at an appropriate different time, the controller may report to the remote computing system that there is a problem with the suction pipe. In response, the remote computing system may attempt to diagnose and repair the problem by exchanging communications with the controller. If that is not successful, a technician may be dispatched to investigate and to repair the problem. When monitoring either of the suction pipe or the sensor tube results in a determination that the sewage pit should be evacuated, the controller performs operations as described herein to cause the vacuum valve to open, thereby evacuating the sewage pit. In some implementations, if everything is working properly, monitoring of both the suction pipe and the sensor tube results in a determination, at the same time or at appropriate different times, that the sewage pit should be evacuated. In this regard, in some implementations, the suction pipe sensor may be set at a higher setting so it only activates if the sensor tube fails. For example, a predefined pressure in the sensor tube may indicate that the pit requires evacuation, while a pressure that exceeds the predefined pressure may be required in the suction pipe to produce an indication that the pit requires evacuation. Thus, in some implementations, a predefined pressure in the sensor tube may indicate that the pit requires evacuation, while a pressure that meets or exceeds, or only exceeds, the predefined level may be required in the suction pipe to produce an indication that the pit requires evacuation.

In an example implementation, to initiate evacuation of the sewage pit, one-half of a predefined pressure must be sensed in the sensor tube. In an example implementation, to initiate evacuation of the sewage pit, three-quarters of the predefined pressure must be sensed in the suction pipe. In an example implementation, to initiate evacuation of the sewage pit, the entire predefined pressure must be sensed in the suction pipe. For example, there may be dual monitoring of the suction pipe. In some implementations, the controller may contain a first switch that closes in response to detecting one-half of the predefined pressure in the sensor tube; a second switch that closes in response to detecting three-quarters of the predefined pressure in the suction pipe; and a third switch that closes in response to detecting the full predefined pressure in the suction pipe. The third switch acts as additional redundancy.

In some implementations, the controller may be configured to control operation of the vacuum valve based on both the pressure sensed in the suction pipe and the pressure sensed in the sensor tube. For example the controller may be configured combine, e.g., to average or otherwise to process, the pressures sensed in the suction pipe and sensor tube. When a predetermined pressure is reached taking into account both the pressures of the sensor tube and the suction pipe, controller 16 may control the intermediary components to open or to close the vacuum valve as described.

As noted, controller 16 may be configured to control vacuum valve 12 so that, following opening, vacuum valve is closed upon expiration of the user- or administrator-set period of time. In some implementations, to close vacuum valve 12, controller 16 may control intermediary device 25 to expose vacuum valve 12 to atmospheric pressure. Exposing vacuum valve to atmospheric pressure causes the vacuum valve to close, thereby re-forming the seal between suction pipe 14 and vacuum pipe 15. In some implementations, as shown in FIG. 1, when evacuated, sewage pit 11 reaches atmospheric pressure. As a result, the pressure in suction pipe 14 reads as atmospheric pressure. Intermediary device 25 may therefore expose vacuum valve 12 to atmospheric pressure through a pipe or other conduit 26 connected between the intermediary device and the sewage pit. Intermediary device 25 may expose vacuum valve 12 to atmospheric pressure through a pipe or other conduit connected between the intermediary device and the surface. Intermediary device 25 may then expose vacuum valve 12 to atmospheric pressure from the sewage pit or surface through a pipe or other conduit 28 connected between the intermediary device and the valve. As explained above, the vacuum valve may be exposed to atmospheric pressure following a user- or administrator-set period of time. In some implementations, pressures other than atmospheric pressure may be applied to the control port of the vacuum valve to cause the vacuum valve to close. In examples such as this, appropriate pressures may be generated using air pressure generators, vacuums, or other appropriate technology.

In some implementations, controller 16 is configured to monitor suction pipe 14 to detect a leak in vacuum valve 12 when the vacuum valve is closed. In some cases, if there is a leak in the vacuum valve, vacuum resulting from the leak will draw waste up into the suction pipe and a resulting pressure loss will be detected by the controller. Controller 16 may use one or more pressure monitors to detect the pressure loss in the suction pipe. Any appropriate technology may be used to detect the pressure loss and to relay that information to the controller. For example, the pressure loss may be represented as vacuum in the suction pipe. In some implementations, controller 16 may contain two switches 32—one to detect a low-level leak and one to detect a high-level leak. In this context, "low" and "high" do not have specific numerical connotations, but rather represent relative values only. For example, if a leak below a certain threshold is detected, the low-level-leak switch will be activated, whereas if a leak at or above the certain threshold is detected, the high-level-leak switch will be activated. Switch activation triggers reaction and operation of the controller. Controller 16 may be configured to communicate information relating to, or representing, the pressure loss to the remote computing system. In response, the remote computing system may attempt to diagnose and repair the problem by exchanging communications with the controller, which would then take appropriate action to fix the issue. If that is not successful, a technician may be dispatched to investigate and to repair the problem.

In some implementations, controller 16 is configured to monitor vacuum pipe 15 to determine if there is enough vacuum to open the vacuum valve. As explained above, in some examples, vacuum pressure of ten (10) inches of mercury or more may be required to open a vacuum valve. The controller may include one or more switches—in this example three switches 33—one to detect an insufficient-level of vacuum in the vacuum pipe, one to detect an acceptable-level of vacuum in the vacuum pipe, and one to detect a preferred-level of vacuum in the vacuum pipe. In some implementations, a switch may be configured to detect a vacuum pressure of less than ten (10) inches of mercury, a switch may be configured to detect a vacuum pressure of ten (10) inches of mercury up to just below fifteen (15) inches of mercury, and a switch may be configured to detect a vacuum pressure of fifteen (15) inches of mercury or more. In some implementations, levels different than five, ten, and fifteen inches of mercury may be used and detected. In an example, a switch may be configured to detect a vacuum pressure of less than three (3) inches of mercury (indicating insufficient vacuum pressure), a switch may be configured to detect a vacuum pressure of seven (7) inches of mercury up to just below twelve (12) inches of mercury (indicating sufficient but not optimal vacuum pressure), and a switch may be configured to detect a vacuum pressure of twelve (12) inches of mercury or more (indicating optimal vacuum pressure). In an example, a switch may be configured to detect a vacuum pressure of four (4) or less inches of mercury (indicating insufficient vacuum pressure), a switch may be configured to detect a vacuum pressure of nine (9) inches of mercury up to just below fourteen (14) inches of mercury (indicating sufficient but not optimal vacuum pressure), and a switch may be configured to detect a vacuum pressure of fourteen (14) inches of mercury or more (indicating optimal vacuum pressure). Any other appropriate values may be as thresholds for measuring vacuum pressure.

Switch activation triggers reaction and operation of the controller in some implementations. Accordingly, information obtained via one of the switches, such as the detected vacuum level or simply an indication that the vacuum level in the vacuum pipe is inadequate, may be conveyed to the remote computing system. For example, the information may simply be an alert or the like identifying a problem. In response, the remote computing system may attempt to diagnose and repair the problem by exchanging communications with the controller. If that is not successful, a technician may be dispatched to investigate and to repair the problem.

Communications between controller 16 and the remote computing system may be implemented wirelessly, over wires, or using a combination of wired and wireless transmissions. Any appropriate communication protocols may be used, and any appropriate data may be exchanged between the controller and the remote computing system. In some implementations, controller 16—and those like it elsewhere on the sewer system—communicate wirelessly with one or more data collection towers (not shown), which aggregate received data and relay the aggregated data back to the remote computing system. A database at the remote computing system may store information about locations throughout the system, and that information may be used by the remote computing system to analyze system operation, to make predictions, to control operation of the system, and to perform any other appropriate tasks. Analytics routines may use, and process, information from the database to identify problems with the sewer system or individual components thereof. For example, the analytics routines may identify areas of the system that are weak, have leaks, have blockages, have breaks, have low vacuum levels, and so forth. The analytics routines may be executed on one or more processing devices, which may be located external to the sewer system (e.g., a remote computer) or internal to the sewer system (e.g., a processing device 5).

In some implementations, the controller is configured to communicate with the remote computing system periodically, intermittently, sporadically, or at any appropriate time. The controller may be configured to check-in with the remote computing system based on data received from the remote computing system. For example, the controller may be configured by the remote computing system to send or to receive data every fifteen (15) minutes, every hour, and so forth. Data received from the remote computing system may dictate the check-in period. To conserve battery in the sewage pit electronics, the check-in period may be made relatively long. In the event of a catastrophic event, the check-in period may be decreased, e.g., to five (5) minutes. Any appropriate times may be used. In the case of a catastrophic event, such as a hurricane, automatic operation of the sewage pits may be discontinued, and each sewage pit may be evacuated manually. In this context, manual evacuation includes addressing each sewage pit remotely using the remote computing system, and sending commands to the controller evacuate the sewage pit. This may be repeated for each sewage pit in the system in order to reduce the chances of flooding.

In some implementations, data and other information are collected across various sewage pits and vacuum stations to identify line leaks and other issues in real-time. In this regard, in some implementations, real-time may not mean that two actions are simultaneous, but rather may include actions that occur on a continuous basis or track each other in time, taking into account delays associated with processing, data transmission, hardware, and the like. By sending vacuum pressure and other appropriate sewage pit status information back to the remote computing system, and performing analyses based at least on a vacuum pressure in each sewage pit, it may be possible to identify leak locations throughout an entire sewer system. By sending vacuum pressure and other appropriate sewage pit status information back to the remote computing system, and performing analyses based at least on a vacuum pressure in each sewage pit, it may be possible to identify blocked locations throughout an entire sewer system. By sending vacuum pressure and other appropriate sewage pit status information back to the remote computing system, and performing analyses based at least on a vacuum pressure in each sewage pit, it may be possible to identify line breakages throughout an entire sewer system. By sending vacuum pressure and other appropriate sewage pit status information back to the remote computing system, and performing analyses based at least on a vacuum pressure in each sewage pit, it may be possible to identify areas having low vacuum throughout an entire sewer system.

In some implementations, the remote computing system may be configured to monitor, and to obtain information from, a number of sewages pits in the system, and to use that information to determine a time it takes to fill a sewage pit, a time it takes to evacuate the sewage pit, and/or other information. The user- or administrator-set period of time to keep the valve open when evacuating a sewage pit may be adjusted dynamically based on this information. For example, system-wide conditions may dictate changes to the user- or administrator-set period, which may be conveyed to the remote computing system, approved by the user or administrator, and then sent back to the controllers. In some cases, these changes to the user- or administrator-set period may be implemented automatically, without requiring user or administrator approval. The user- or administrator-set period of time to keep the valve open may also be adjusted dynamically based on other factors, such as weather or other environmental conditions. For example, in the event of heavy rain, the times may be decreased to reduce the chance that the system may be flooded. As above, changes may be implemented automatically (e.g., without user intervention) or following approval. In some cases—for example, in cases of little-used systems—sewage pits for those systems may be controlled to evacuate less often than sewages pits that are under heavy or constant use. Bills to customers for system use may be determined based on usage amounts determined by monitoring performed by system controllers.

In some implementations, the remote computing system may calculate, based on the valve-open times and fluid flow rates, the amount of content expected to be in the sewer system. If the amount of content is considerably more, or considerably less, than expected, this may be an indication of an error in the system. The location of the error may be identified based on information from one or more of the controllers in the system. In some implementations, the remote computing system may identify how quickly each sewage pit cycles, and then use that information to set, automatically (e.g., without user intervention), schedules for inspecting each sewage pit, servicing each sewage pit, and so forth. In some implementations, the remote computing system may use information obtained from the controllers to generate efficiency reports relating to the operation of the sewer system or individual sewage pits.

Figure 4:
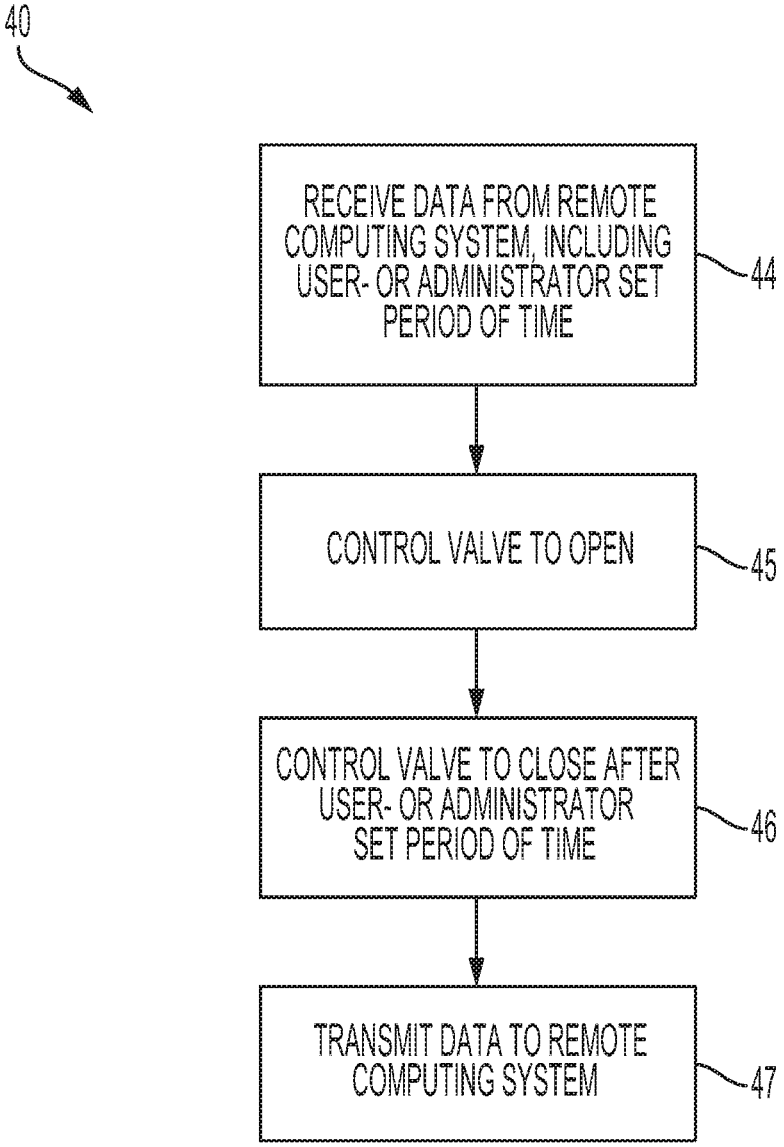
FIG. 4 is a flowchart showing an example process for operating at least part of the example vacuum sewer system.

FIG. 4 shows an example process 40 that may be performed by a controller, such as controller 16. According to example process 40, the controller receives (44) data from a remote computing device. The data includes, among other things, data representing the user- or administrator-set period of time for which the vacuum valve is to remain open. That data is stored at appropriate location(s) in memory on the controller or elsewhere in electronics in the sewage pit. The controller controls (45) the vacuum valve to open. For example, the controller controls one or more intermediary components to apply vacuum to the control port of the vacuum valve, resulting in the vacuum valve opening in response to appropriate pressure in the vacuum pipe. Following the user- or administrator-set period of time, the controller controls (46) the vacuum valve to close. This may be done by exposing the control port of the vacuum valve to atmospheric or other non-vacuum pressure. During, after, or before the controller controls (46) the vacuum valve to close, controller transmits (47) data to the remote computing system, which data may represent all or some of the information described herein or other appropriate data collected by the controller.

In some implementations, each sewage pit, an example of which is shown in FIGS. 1 and 3, includes its own power supply, such as a battery. The battery may be a dual-voltage supply. In an example, the battery may provide 3.6V to power parts of the controller and 12V to power the intermediary device, such as the solenoid, the servo-motor, or the stepper motor. The system; however, is not limited to using a power supply having these particular voltages or to use with a dual-voltage power supply.

The example process described herein may be implemented by, and/or controlled using, one or more controllers or computer systems comprising hardware or a combination of hardware and software. For example, a system like the ones described herein may include various controllers and/or processing devices located at various points in the system to control operation of the automated elements. A central computer may coordinate operation among the various controllers or processing devices. The central computer, controllers, and processing devices may execute various software routines to effect control and coordination of the various automated elements.

The example process described herein can be controlled, at least in part, using one or more computer program products, e.g., one or more computer program tangibly embodied in one or more information carriers, such as one or more non-transitory machine-readable media, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the testing can be performed by one or more programmable processors executing one or more computer programs to perform the functions described herein. All or part of the testing can be implemented using special purpose logic circuitry, e.g., an FPGA (field programmable gate array) and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only storage area or a random access storage area or both. Elements of a computer (including a server) include one or more processors for executing instructions and one or more storage area devices for storing instructions and data. Generally, a computer will also include, or be operatively coupled to receive data from, or transfer data to, or both, one or more machine-readable storage media, such as mass storage devices for storing data, e.g., magnetic, magneto-optical disks, or optical disks. Machine-readable storage media suitable for embodying computer program instructions and data include all forms of non-volatile storage area, including by way of example, semiconductor storage area devices, e.g., EPROM, EEPROM, and flash storage area devices; magnetic disks, e.g., internal hard disks or removable disks; magneto-optical disks; and CD-ROM and DVD-ROM disks.

Any "electrical connection" as used herein may imply a direct physical connection or a wired or wireless connection that includes or does not include intervening components but that nevertheless allows electrical signals to flow between connected components. Any "connection" involving electrical circuitry that allows signals to flow, unless stated otherwise, is an electrical connection and not necessarily a direct physical connection regardless of whether the word "electrical" is used to modify "connection".

Elements of different implementations described herein may be combined to form other embodiments not specifically set forth above. Elements may be left out of the structures described herein without adversely affecting their operation. Furthermore, various separate elements may be combined into one or more individual elements to perform the functions described herein.

What is claimed is:

1. A system comprising:

a sewage pit;

a suction pipe extending into the sewage pit;

a suction pipe sensor to sense pressure in the suction pipe;

a valve between the sewage pit and a vacuum pipe having a vacuum pressure, the valve being controllable to close or to open to allow content to flow from the sewage pit, through the suction pipe, to the vacuum pipe;

a sensor tube extending into the sewage pit to sense a fill level of the sewage pit, the sensor tube comprising a pressure sensor; and a controller configured to determine whether a first pressure from the suction pipe sensor meets or exceeds a predefined level and to cause the valve to open to evacuate the sewage pit if the first pressure meets or exceeds the predefined level and (i) a second pressure from the sensor tube does not meet or exceed the predefined level or (ii) the second pressure is not available from the sensor tube due to error in the sensor tube.

2. The system of claim 1, wherein, in response to the first pressure meeting or exceeding the predefined level, the valve is controlled to open and thereby allow content to flow from the sewage pit to the vacuum pipe.

3. The system of claim 1, wherein, in response to the first pressure meeting or exceeding the predefined level, the valve is controlled to remain open for a period of time to evacuate at least part of the content from the sewage pit, the period of time being user-settable.

4. The system of claim 3, wherein the valve is controlled to close following the predetermined period of time after the valve is open.

5. The system of claim 1, further comprising:

a switch configured to close in response to the first pressure meeting or exceeding the predefined level, wherein opening of the valve is based on closing of the switch.

6. The system of claim 5, further comprising:

a servo-motor configured for activation in response to closure of the switch, the servo-motor being configured to control opening the valve following activation.

7. The system of claim 1, wherein the predefined level is indicative of a fill level of the sewage pit.

8. The system of claim 1, wherein the valve is controlled to close based on the pressure in the suction pipe only.

9. The system of claim 1, wherein, a case that the first pressure meets or exceeds a predefined level and the second pressure does not meet or exceed the predefined level comprises an error associated with the sensor tube.

10. The system of claim 1, wherein the suction pipe has a serrated end that extends into the sewage pit.

11. The system of claim 1, further comprising:

a remote computing system configured to process information relating to multiple sewage pits, including the sewage pit, to identify a problem associated with a sewer system.

12. The system of claim 1, wherein the valve is caused to open for a predefined period of time.

13. The system of claim 12, wherein the predefined period of time is settable by an administrator of the system.

14. The system of claim 12, wherein the predefined period of time is between one (1) second (s) and three (3) seconds.

15. The system of claim 12, wherein the predefined period of time is at least one (1) second.

16. The system of claim 12, further comprising:

a switch configured to close in response to the first pressure meeting or exceeding a predefined level, wherein opening of the valve is based on closing of the switch, and wherein closing of the switch is based at least on the first pressure.

17. The system of claim 16, further comprising:

a servo-motor configured for activation in response to closure of the switch, the servo-motor being configured to control opening the valve following activation.

18. The system of claim 16, further comprising:

a stepper motor configured for activation in response to closure of the switch, the stepper motor being configured to control opening the valve following activation.

19. The system of claim 12, wherein the predefined period of time is independent of air, liquid, or both air and liquid passing through the valve.

20. The system of claim 12, wherein the predefined period of time is at least nine (9) seconds.

21. The system of claim 12, wherein the predefined period of time is at least ten (10) seconds.

22. The system of claim 12, further comprising:

a computing system to control the valve based on a predefined period of time set by a user.

* * * * *